US007185703B2

(12) United States Patent
Jannise et al.

(10) Patent No.: US 7,185,703 B2
(45) Date of Patent: Mar. 6, 2007

(54) DOWNHOLE COMPLETION SYSTEM AND METHOD FOR COMPLETING A WELL

(75) Inventors: Richard C. Jannise, Katy, TX (US); Michael L. Larpenter, Highlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 192 days.

(21) Appl. No.: 10/872,236

(22) Filed: Jun. 18, 2004

(65) Prior Publication Data

US 2006/0005964 A1 Jan. 12, 2006

(51) Int. Cl.
*E21B 43/26* (2006.01)

(52) U.S. Cl. ..... 166/308.1; 166/177.5; 166/250.1

(58) Field of Classification Search ..... 166/308.1, 166/177.5
See application file for complete search history.

(56) References Cited

U.S. PATENT DOCUMENTS

| | | | |
|---|---|---|---|
| 5,161,613 | A | 11/1992 | Jones |
| 5,381,864 | A | 1/1995 | Nguyen |
| 5,417,284 | A | 5/1995 | Jones |
| 5,499,678 | A | 3/1996 | Surjaatmadja et al. |
| 5,515,915 | A | 5/1996 | Jones et al. |
| 5,533,571 | A | 7/1996 | Surjaatmadja et al. |
| 5,722,490 | A | 3/1998 | Ebinger |
| 5,765,642 | A | 6/1998 | Surjaatmadja |
| 5,848,645 | A | 12/1998 | Jones |
| 6,059,032 | A | 5/2000 | Jones |
| 6,095,245 | A | 8/2000 | Mount |

(Continued)

OTHER PUBLICATIONS

Surjaatmadja, Jim B., "SurgiFrac: A Method to Effectively, Accurately and Selectively Place Many Fractures in a Well," paper prepared for presentation at SPE Section Meetings; Nov. 10-11, 1999, 14 pages.

Halliburton Fracturing, "SurgiFracSM Service—Fracture Stimulation Technique for Horizontal Completions in Low- to Medium-Permeability Reservoirs," copyright 2003, 6 pages.

Field Development Frac Pack Gas Processing, Journal of Petroleum Technology, Sep. 2003, 3 pages.

Jannise, Ricki, "Review of BJ Services Reduced Trip Gravel Pack System,"Presentation by Ed Smith with BJ Services Formerly With OSCA and Amoco, Apr. 16, 2003, 3 pages.

(Continued)

*Primary Examiner*—William Neuder
*Assistant Examiner*—Nicole A Coy
(74) *Attorney, Agent, or Firm*—Lawrence R. Youst

(57) ABSTRACT

A system for completing a well having casing (34) includes a perforating assembly (38) and a tubing string assembly (40). The tubing string assembly (40) including a pair of seal assemblies (56, 74), a production screen assembly (58) and a ported sleeve (66) positioned between the seal assemblies (56, 74) and a live annulus screen assembly (76) positioned uphole of the seal assemblies (56, 74). The perforating assembly (38) is operated to perforate the well and is then released downhole. The tubing string assembly (40) is then repositioned such that the production screen assembly (58) is located proximate the perforated interval (14) so that when the well is hydraulically fractured with a treatment slurry that is pumped through the ported sleeve (66), the formation reaction to the fracturing is monitored by obtaining pressure readings in the annulus in fluid communication with the live annulus screen assembly (76).

55 Claims, 4 Drawing Sheets

U.S. PATENT DOCUMENTS 6,253,851 B1 7/2001 Schroeder, Jr. et al.
6,364,017 B1 4/2002 Stout et al.
6,382,319 B1 5/2002 Hill, Jr. et al.
6,394,184 B2 * 5/2002 Tolman et al. ..... 166/281
6,464,006 B2 10/2002 Womble
6,481,494 B1 11/2002 Dusterhoft et al.
6,488,082 B2 12/2002 Echols et al.
6,516,881 B2 2/2003 Hailey, Jr.
6,557,634 B2 5/2003 Hailey, Jr. et al.
6,568,474 B2 * 5/2003 George et al. ..... 166/278
2003/0062167 A1 4/2003 Suraatmadja et al.

* cited by examiner

DOWNHOLE COMPLETION SYSTEM AND METHOD FOR COMPLETING A WELL

TECHNICAL FIELD OF THE INVENTION

This invention relates, in general, to a downhole completion system and a method for completing a well that traverses a hydrocarbon bearing subterranean formation and, in particular, to a system and method for perforating the well then treating the well without the use of a drilling or workover rig.

BACKGROUND OF THE INVENTION

Without limiting the scope of the present invention, its background will be described with reference to completing a well that traverses a hydrocarbon bearing subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation. Conventionally, each section of the casing string is cemented within the wellbore before the next section of the wellbore is drilled.

Once this well construction process is finished, the completion process may begin. The completion process comprises numerous steps. For example, hydraulic openings or perforations are typically created through the casing string, the cement and a short distance into the desired formation by detonating shaped charges carried in a perforating gun. The perforations allow production fluids from the subterranean formation to enter the interior of the wellbore. Once the perforations are created, however, the formation pressure must be controlled. Typically, this is achieved by loading a completion fluid into the wellbore during the completion process. The completion fluid has a density sufficient to create an overbalanced hydrostatic pressure regime at the location or locations of the wellbore perforations, thereby preventing formation fluids from entering the wellbore.

After the well is perforated, a stimulation or sand control treatment process may be performed. For example, a work string including a service tool, a gravel pack packer, a ported housing and port closure sleeve, a sealbore housings, a check valve, a wash pipe extending through the screen, a lower seal assembly and a sump packer may be run downhole. A treatment fluid, which may contain sand, gravel or proppants, is then pumped down the work string and either into the wellbore annulus, into the formation or both depending upon the desired results of the treatment process.

Following the treatment process, it remains necessary to have completion fluid in the wellbore to control formation pressure during the remainder of the completion process. Typically, this process includes tripping portions of the work string out of the wellbore and installing a production tubing string within the wellbore. The production tubing string is used to produce the well by providing the conduit for formation fluids to travel from the formation depth to the surface. In addition, the production tubing string may include various operating tools including flow control devices, safety devices and the like which regulate and control the production of fluid from the wellbore. Once the production tubing string has been installed and the completion fluid is removed from the well, production may begin.

It has been found, however, that the use of high density completion fluids to control the well during the completion process has numerous drawbacks. First, it is often desirable to perforate the well in an underbalanced hydrostatic pressure regime so that the resulting influx of formation fluids into the wellbore immediately cleans the perforation tunnels. Second, the use of high density completion fluids may result in fluid loss from the wellbore, through the perforation and into the formation during the various trips into and out of the wellbore. The introduction of this fluid into the formation may damage the formation by for, example, forming a skin near the surface of the wellbore or more critically, by promoting swelling and loss of permeability deeper within the formation. In addition, it has been found that most completion processes require the use of a drilling or workover rig during the entire completion to support equipment during the various trips into and out of the wellbore.

Therefore, a need has arisen for a system and method for completing a well that allows for an underbalanced hydrostatic pressure regime during the perforation process. A need has also arisen for such a system and method for completing a well that reduces the likelihood of fluid loss into the formation by minimizing the time it takes to complete the well and by reducing the trips into and out of the well. Further, need has arisen for such a system and method for completing a well that does not require the use of a drilling or workover rig during the treatment phase of the completion process.

SUMMARY OF THE INVENTION

The present invention disclosed herein comprises a system and method for completing a well that allow for an underbalanced hydrostatic pressure regime during the perforation process. The system and method of the present invention also reduce the likelihood of fluid loss into the formation by minimizing the time it takes to complete the well and by reducing the trips into and out of the well. In addition, the system and method of the present invention do not require the use of a drilling or workover rig during the treatment phase of the completion process.

The system of the present invention includes a perforating assembly that is positioned within the well casing at a location proximate a production interval and a tubing string assembly that is initially positioned within the casing uphole of the perforating assembly. The perforating assembly may be positioned within the casing prior to running the tubing string assembly into the casing, for example, on an electric wireline run. Alternatively, the perforating assembly may initially be connected to the downhole end of the tubing string assembly and then disconnected from the tubing string assembly when the perforating assembly is positioned proximate the production interval.

The tubing string assembly includes first and second seal assemblies. The second seal assembly is positioned uphole of the first seal assembly. The tubing string assembly also has a first screen assembly and a ported sleeve that are positioned between the first and second seal assemblies. In addition, the tubing string assembly has a second screen assembly that is positioned uphole of the second seal assembly.

In operation, once the tubing string assembly is positioned uphole of the perforating assembly, the perforating assembly may be operated to form perforations in the casing adjacent to the production interval. Preferably, an underbalanced hydrostatic pressure regime is present during the perforating operation such that an influx of formation fluids will clean the perforation tunnels. The underbalanced hydrostatic pressure regime may be created by pumping a relatively light completion fluid into the tubing string and operating a flow control device within the tubing string to a closed position such that the well will be contained following the perforating operation. Substantially simultaneously with the operation of the perforating assembly, the perforating assembly is released downhole.

Shortly after the perforating process is complete, the tubing string assembly is repositioned within the casing such that the first screen assembly is proximate the production interval. The second seal assembly, which is preferably a mechanically operated seal assembly, is now set. At this point, the drilling or workover rig may be removed from the well and a wellhead may be installed on the well, thereby completely containing the well. The first seal assembly, which is preferably a hydraulically operated seal assembly, is now set such that the production interval is isolated.

A flow control device positioned between the first screen assembly and the ported sleeve, which is used to temporarily prevent flow from within the tubing string to the interior of the first screen assembly, is now operated to the closed position. The well may now be hydraulically fractured by pumping a treatment slurry through the tubing string and out the ported sleeve while preventing fluid returns through the sand control screen. During the fracturing operation, the formation reaction to the fracturing is monitored by obtaining a pressure reading in the annulus surrounding the second screen assembly which is taken by a pressure sensor positioned proximate the surface. The system of the present invention is particularly advantageous in that the formation reaction is measured in a live annulus as at least a portion of the fluid component of the treatment slurry passes through the second screen assembly during the fracturing operation, thereby placing the surrounding annulus and the formation in fluid communication with one another.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
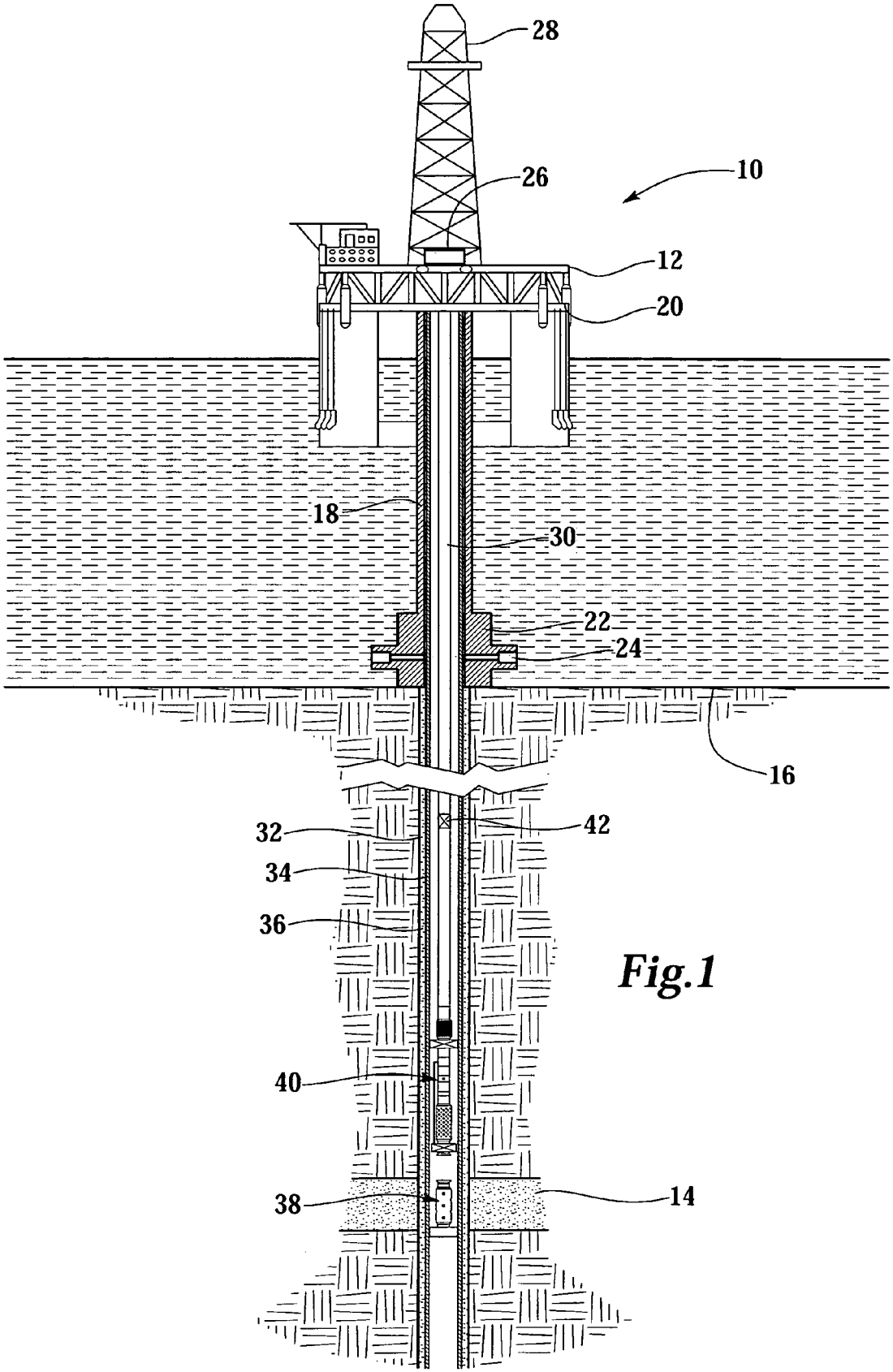
FIG. 1 is a schematic illustration of an offshore oil and gas platform operating a system for completing a well according to the present invention.

Referring initially to FIG. 1, a downhole completion system of the present invention is being operated from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as tubing string 30.

A wellbore 32 extends through the various earth strata including formation 14. A casing 34 is cemented within wellbore 32 by cement 36. Positioned within casing 32 is the downhole completion system of the present invention. Specifically, the downhole completion system of the present invention includes a perforating assembly 38 that is positioned within casing 34 at a location proximate the production interval of formation 14. Additionally, the downhole completion system of the present invention includes a tubing string assembly 40 having a subsurface safety valve 42 positioned therewith. Tubing string assembly 40 is depicted in a position within casing 34 uphole of perforating assembly 38.

Perforating assembly 38 is preferably positioned within casing 34 prior to the installation of tubing string assembly 40. This is achieved by running perforating assembly 38 downhole on a conveyance such as a wireline, a coiled tubing or preferably an electric wireline with logging capabilities such that the precise location for positioning perforating assembly 38 within casing 34 can be determined. In this case, tubing string assembly 40 is run downhole until the downhole end of tubing string assembly 40 contacts the uphole end of perforating assembly 38. Tubing string assembly 40 is then partially retrieved uphole to the location depicted in FIG. 1 such that the shock created when perforating assembly 38 is fired does not affect any of the components of tubing string assembly 40.

Alternatively, perforating assembly 38 may initially be coupled to the downhole end of tubing string assembly 40 such that only a single run is required for the installation of the downhole completion system of the present invention. In this case, once perforating assembly 38 is positioned within casing 34 proximate formation 14, perforating assembly 38 is disconnected from tubing string assembly 40 such that tubing string assembly 40 may be partially retrieved uphole to the location depicted in FIG. 1. Once perforating assembly 38 and tubing string assembly 40 are in this position, the completion of the well may begin.

Even though FIG. 1 depicts a vertical well, it should be noted by one skilled in the art that the downhole completion system of the present invention is equally well-suited for use wells having other orientations including deviated wells, inclined wells, substantially horizontal wells and the like. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be noted by one skilled in the art that the downhole completion system of the present invention is equally well-suited for use in onshore operations.

Figure 2:
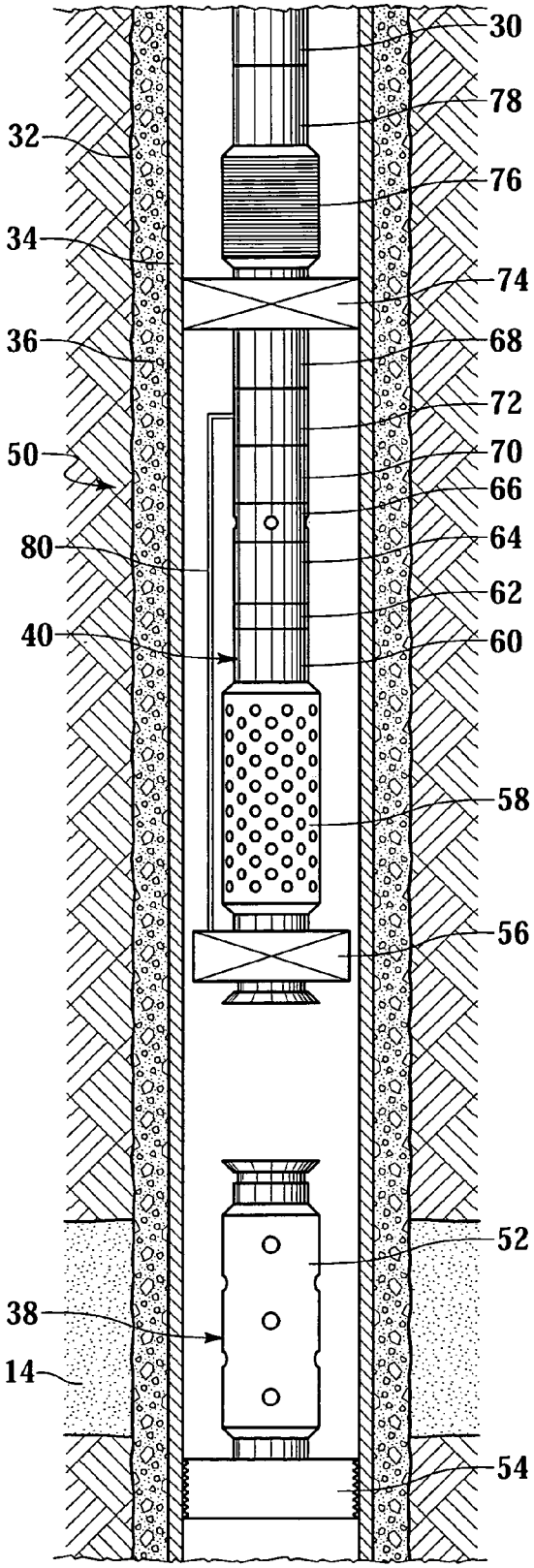
FIG. 2 is a schematic illustration of a system for completing a well according to the present invention in a first operating configuration.
Figure 3:
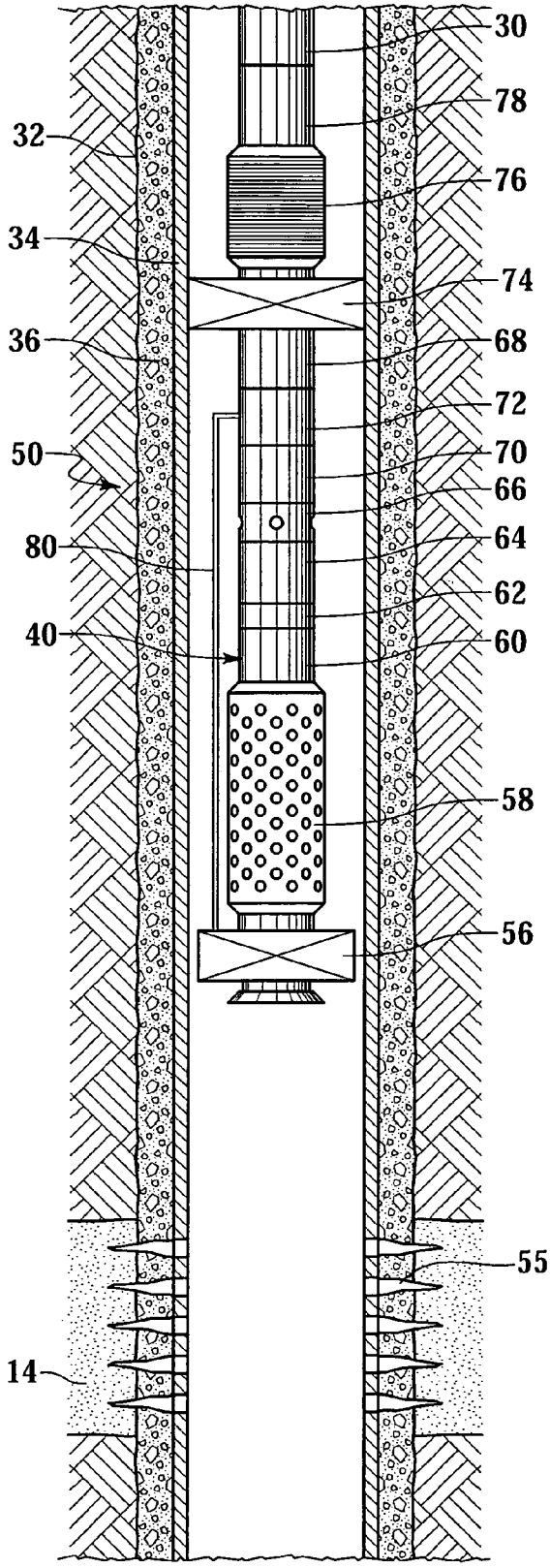
FIG. 3 is a schematic illustration of a system for completing a well according to the present invention in a second operating configuration.

Referring next to FIG. 2, therein is depicted a more detailed view of the downhole completion system of the present invention in a downhole environment that is generally designated 50. The downhole completion system includes perforating assembly 38 and tubing string assembly 40. More specifically, the illustrated perforating assembly 38 includes a perforating gun 52 and an auto release gun hanger 54. Preferably perforating gun 52 includes a plurality of shaped charges contained within a charge carrier such that when the shaped charges are detonated, each shaped charge creates a jet that blasts through a scallop or recess in the charge carrier, creates a hydraulic opening through casing 34 and cement 36 and then penetrates formation 14 forming a perforation 55 therein, as best seen in FIG. 3. Perforating gun 52 may be activated by any suitable signaling process, however, perforating gun 52 is preferably a pressure activated perforating gun. Once the shaped charges have been detonated, auto release gun hanger 54 disengages from casing 34, also as best seen in FIG. 3, and falls into the rat hole (not pictured) of wellbore 32.

Even though a particular embodiment of perforating assembly 38 has been depicted and described, it should be clearly understood by those skilled in the art that additional, different or fewer components could alternatively be used with perforating assembly 38 without departing from the principles of the present invention. For example, perforating assembly 38 may alternatively be a disappearing perforating gun that disintegrates upon firing or may be retrievable uphole via wireline or other suitable conveyance through tubing string assembly 40 after firing.

Tubing string assembly 40 includes, from the downhole end to the uphole end, a seal assembly 56, a sand control screen assembly 58 with blank pipe 60, a flow control device 62, a polished bore receptacle 64, a ported sleeve 66, a flow control device 70, a ported landing nipple 72, a tubing swivel shear assembly 68, a seal assembly 74, a screen wrapped sliding sleeve 76 and a polished bore receptacle 78. Extending between ported landing nipple 72 and seal assembly 56 is a hydraulic conduit 80.

In the illustrated embodiment, seal assembly 56 is depicted as a hydraulically operated seal assembly that is actuated by transmitting fluid pressure to seal assembly 56 from tubing string 30 via hydraulic conduit 80 as explained in greater detail below. It is to be clearly understood, however, by those skilled in the art that other types of sealing devices could alternatively be used including, but not limited to, mechanically set seal assemblies, cup packers and the like.

Sand control screen assembly 58 provides for the filtration of formation fluid and the prevention of formation fines and packing-solids, such as sand, gravel or proppants from entering the interior of tubing string assembly 40 during production from formation 14 and completion of the well. Sand control screen assembly 58 may have any type of suitable filtration media, including, but not limited to, a fluid-porous, particulate restricting, metal mesh material such as a plurality of layers of a wire mesh that are sintered or diffusion bonded together to form a porous wire mesh screen designed to allow fluid flow therethrough but prevent the flow of particulate materials of a predetermined size from passing therethrough.

Flow control device 62 selectively permits and prevents the flow of fluid through tubing string assembly 40 between polished bore receptacle 64 and blank pipe 60. Flow control device 62 may be any type of suitable valving or plugging device, including, but not limited to, a dart catcher having a seat for receiving a dart or other plugging device that may be introduced into the well at the surface and gravitationally or via fluid pressure be landed into the seat to provide a fluid tight seal therewith.

Polished bore receptacle 64 provides an internal polished surface such that other equipment can be placed or landed therein to create a hydraulic seal. Ported sleeve 66 selectively provides for circulation between the interior of tubing string assembly 40 and the annulus between tubing string assembly 40 and casing 34 between seal assembly 56 and seal assembly 74. In particular, during a treatment process such as a gravel pack, fracture stimulation, frac pack, extension pack, water pack or the like, a treatment fluid such as a treatment slurry containing a fluid component and a solid component such as sand, gravel, proppants or the like is pumped down tubing string assembly 40 and exits through ported sleeve 66 into the annulus between tubing string assembly 40 and casing 34. Prior to and following the treatment process, ported sleeve 66 can be operated to the closed position to prevent circulation between the interior of tubing string assembly 40 and the annulus between tubing string assembly 40 and casing 34.

Flow control device 70 selectively permits and prevents the flow of fluid through tubing string assembly 40 between ported landing nipple 72 and ported sleeve 66. Flow control device 70 may be any type of suitable valving or plugging device, including, but not limited to, a collet dart catcher having a seat for receiving a dart or other plugging device that may be introduced into the well at the surface and gravitationally or via fluid pressure be landed into the seat to provide a fluid tight seal therewith. Once the dart has landed in the seat, sufficient pressure will cause the dart to pass entirely through flow control device 70 allowing the flow of fluid through tubing string assembly 40 between ported landing nipple 72 and ported sleeve 66.

Ported landing nipple 72 provides a seat into which various types of receivable tools such as flow control devices, safety devices and the like having external movable locking devices can be landed. In addition, ported landing nipple 72 selectively permits and prevents fluid communication from the interior of tubing string assembly 40 to hydraulic conduit 80.

Tubing swivel shear assembly 68 enables some relative movement of the components within tubing string assembly 40 such as allowing for rotation, swivel or the like of tubing string assembly 40. In addition, during a subsequent intervention into wellbore 32 wherein it is desirable to remove tubing string 30 from the well but leave sand control screen assembly 58 downhole, tubing string assembly 40 can be separated at tubing swivel shear assembly 68.

Seal assembly 74 provides for a sealing and gripping relationship between tubing string assembly 40 and casing 34. Seal assembly 74 may be any type of suitable sealing device known in the art including, but not limited to, a pair of oppositely oriented cup packer, a hydraulically set packer or the like. Seal assembly 74 is preferably, however, a mechanically set seal assembly capable of being set, released and set again.

Screen wrapped sliding sleeve 76 selectively provides for circulation between the interior of tubing string assembly 40 and the annulus between tubing string assembly 40 and casing 34 above seal assembly 74 when seal assembly 74 is set. In addition, screen wrapped sliding sleeve 76 has a wire wrapped screen positioned therearound that prevents the flow of solids, such as sand, gravel or proppants from the interior of tubing string assembly 40 to the annulus between tubing string assembly 40 and casing 34 during a treatment process. Even though the illustrated embodiment depicts a wire wrapped screen in association with screen wrapped sliding sleeve 76, it should be understood by those skilled in the art that screen wrapped sliding sleeve 76 may utilize any type of suitable filtration media that allows the flow of fluid therethrough but prevents the flow of particulate materials of a predetermined size from passing therethrough. Alternatively, other types of radial fluid flow control devices that provide selective fluid communication from the interior to the exterior of tubing string assembly 40 that operate with or without a screen positioned therearound could be used.

Polished bore receptacle 78 provides an internal polished surface such that other equipment can be placed or landed therein to create a hydraulic seal. Polished bore receptacle 78 may also enable some relative movement of the components within tubing string assembly 40. In particular, polished bore receptacle 78 allows for the increase and decrease in the length of tubing string assembly 40 such that expansion and contraction of tubing string assembly 40 during treatment processes and production are allowed without placing undue stress on tubing string assembly 40.

Even though a particular embodiment of tubing string assembly 40 has been depicted and described, it should be clearly understood by those skilled in the art that additional, different or fewer components could alternatively be used with tubing string assembly 40 without departing from the principles of the present invention.

An exemplary completion process will now be described using the downhole completion system of the present invention with reference to FIGS. 2–6. As depicted in FIG. 2, perforating assembly 38 has been positioned within casing 34 at a location proximate the production interval of formation 14. Likewise, tubing string assembly 40 has been positioned within casing 34 uphole of perforating assembly 38. As stated above, perforating assembly 38 may be positioned in casing 34 on an electric wireline run such that the precise location for positioning perforating assembly 38 within casing 34 can be determined using logging equipment. Alternatively, perforating assembly 38 may be positioned in casing 34 in conjunction with the installation of tubing string assembly 40. In either case, tubing string assembly 40 is preferably positioned 90 feet to 120 feet uphole of perforating assembly 38 during the perforation process.

Seal assembly 74 is mechanically set to provide a sealing and gripping relationship between tubing string assembly 40 and casing 34, as best seen in FIG. 2. Initially, flow control device 62 is in the open position, ported sleeve 66 is in the open position, flow control device 70 is in the open position, ported landing nipple 72 is in the closed position and screen wrapped sliding sleeve 76 is in the closed position. The downhole completion system of the present invention is now in position for the perforation process.

Tubing string assembly 40 is now or has previously been filled with a completion fluid selected to create an underbalanced hydrostatic pressure regime upon perforating the well. Subsurface safety valve 42 of FIG. 1 or other suitable flow control device within tubing string 30 is closed. Tubing string assembly 40 is now pressurized such that the pressure is communicated to perforating assembly 38. The pressure activates perforating gun 52 such that the shaped charges within perforating gun 52 are detonated and perforation 55 are formed through casing 34 and cement 36 into formation 14, as best see in FIG. 3. As the completion fluid within tubing string assembly 40 has been selected to create an underbalanced hydrostatic pressure regime, there is an influx of formation fluid into wellbore 32 which cleans perforation tunnels 55. Substantially simultaneously with the activation of perforating gun 52, auto release gun hanger 54 disengages from casing 34, also as best seen in FIG. 3, which allows perforating assembly 38 to fall into the rat hole (not pictured) of wellbore 32.

Figure 4:
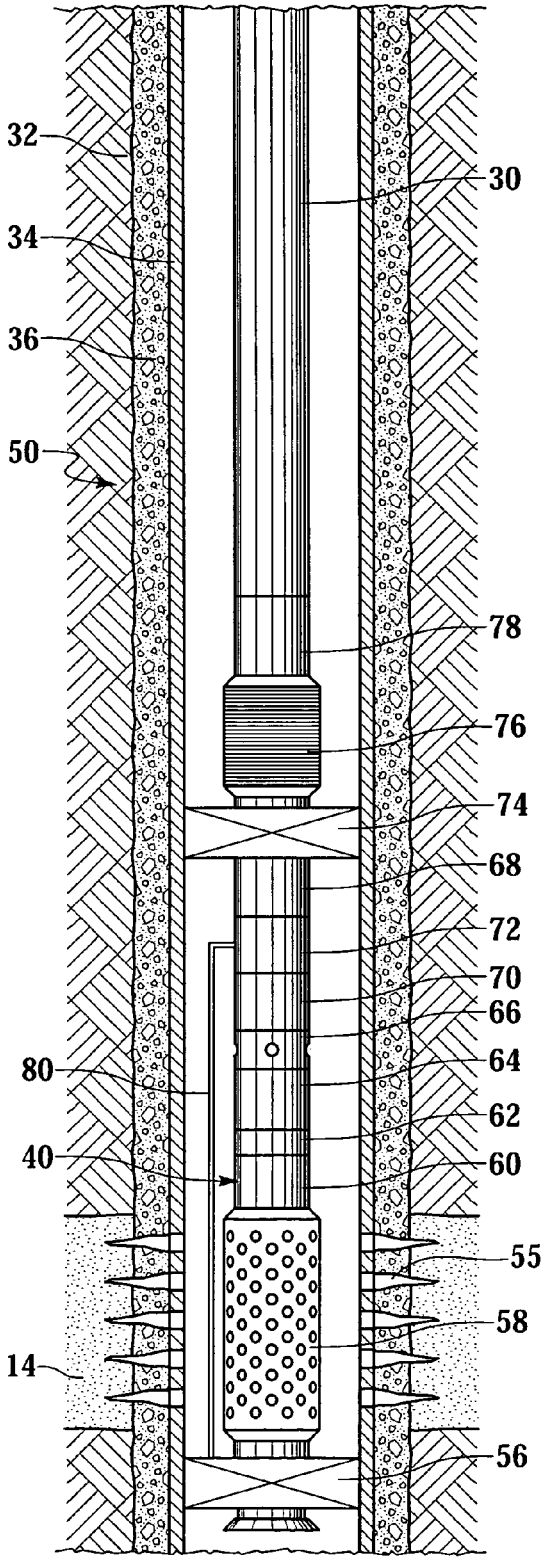
FIG. 4 is a schematic illustration of a system for completing a well according to the present invention in a third operating configuration.

The annulus between tubing string assembly 40 and casing 34 above seal assembly 74 is now pressurized and screen wrapped sliding sleeve 76 is operated to the open position to allow fluid communication between the inside of tubing string assembly 40 and the annulus between tubing string 30 and casing 34 above seal assembly 74. A kill weight is circulated into wellbore 32 to fully contain the pressure from formation 14. Seal assembly 74 is mechanically released from its sealing and gripping relationship with casing 34 such that tubing string assembly 40 can be repositioned within casing 34. As best seen in FIG. 4, tubing string assembly 40 is moved downhole such that sand control screen assembly 58 is positioned proximate perforation 55. Seal assembly 74 is mechanically reset to form a sealing and gripping relationship with casing 34. At this point, tubing string 30 may optionally be pulled against seal assembly 74 with sufficient force to break the shear pins within polished bore receptacle 78 such that tubing string assembly 40 can be spaced out to account for future temperature variation within tubing string assembly 40, if desired.

At the surface, the drilling or workover rig can be released from the well and a wellhead may be landed in place such that there is total containment of the well. A dart is then introduced into tubing string assembly 40 and landed in a seat within flow control device 70. Tubing string assembly 40 is again pressurized. Due to the seal within flow control device 70, the pressure is transmitted to seal assembly 56 via ported landing nipple 72 and hydraulic conduit 80, which hydraulically sets seal assembly 56, as best seen in FIG. 4, such that formation 14 is isolated between seal assembly 56 and seal assembly 74.

Figure 5:
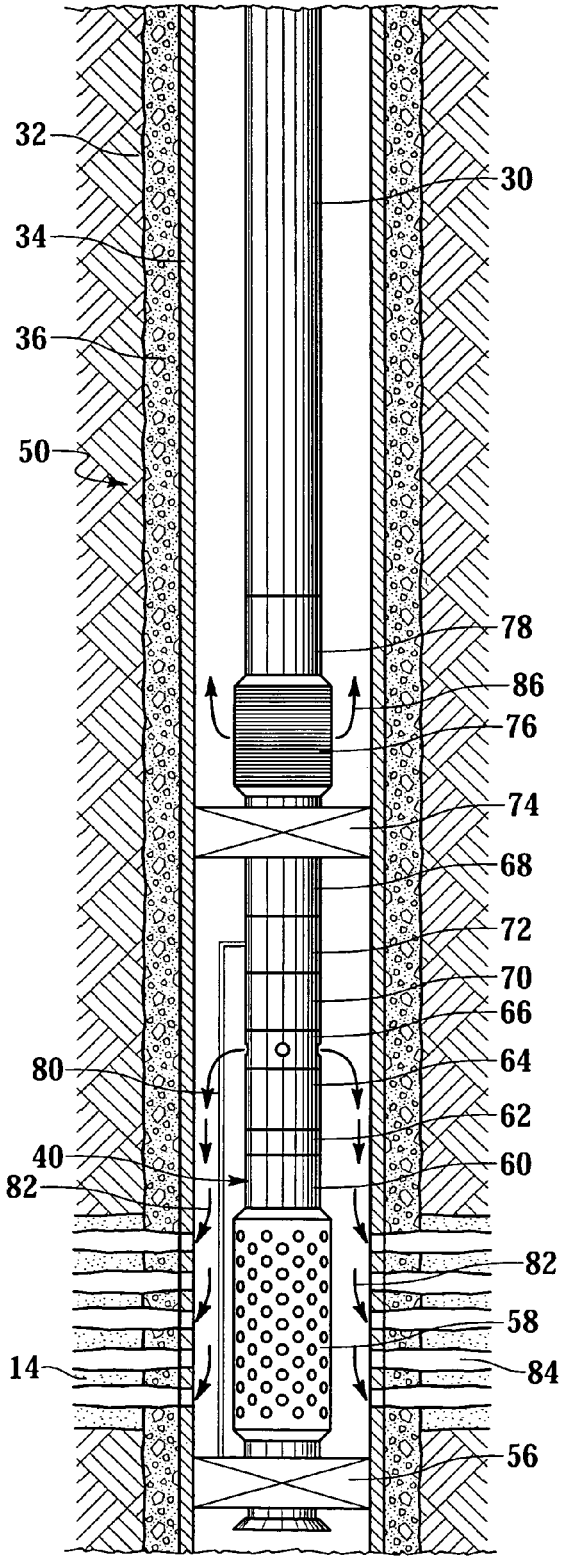
FIG. 5 is a schematic illustration of a system for completing a well according to the present invention in a fourth operating configuration.

Increasing the pressure within tubing string assembly 40 now causes the dart to pass through flow control device 70 and land in the seat within flow control device 62. A treatment slurry such as a fracture fluid is now pumped down tubing string assembly 40, out ported sleeve 66 into the annulus defined between tubing string assembly 40 and casing 34 between seal assembly 56 and seal assembly 74. The fracture fluid, represented by arrows 82, is forced into formation 14 as no returns are being taken into sand control screen assembly 58 such that fractures 84 are formed in the production interval of formation 14, as best seen in FIG. 5.

Figure 6:
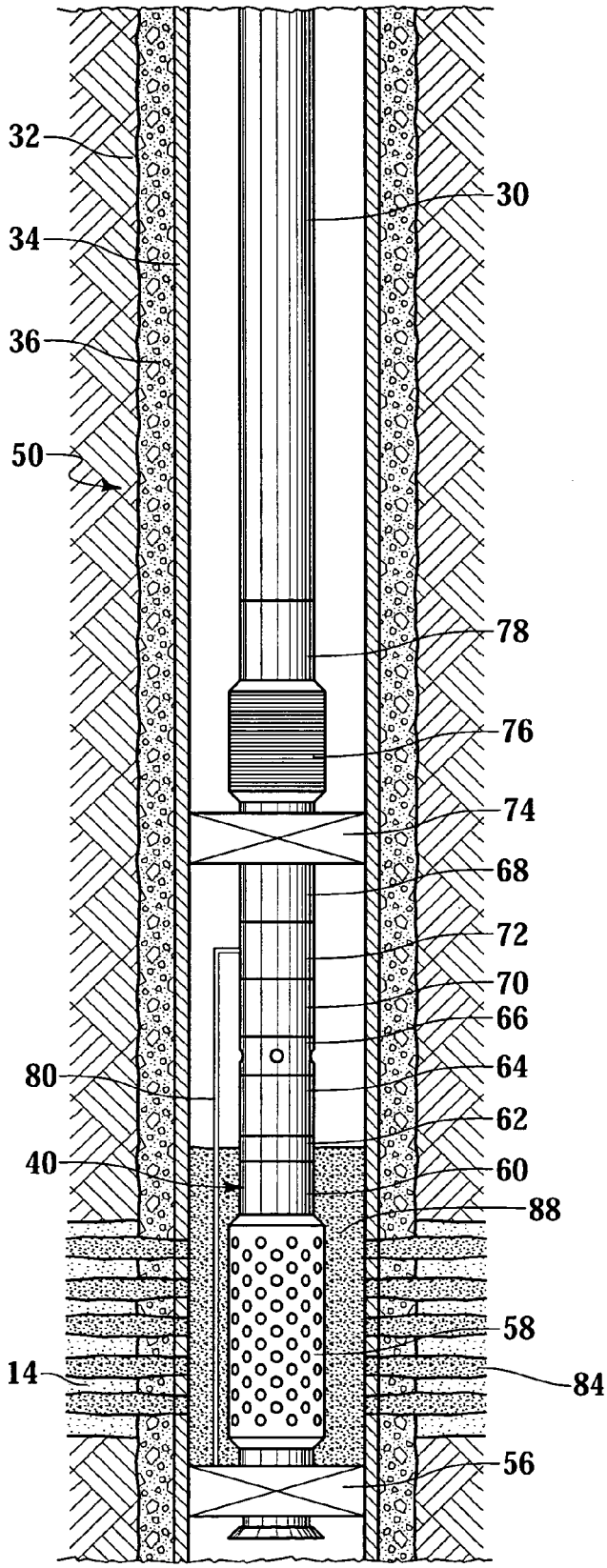
FIG. 6 is a schematic illustration of a system for completing a well according to the present invention in a fifth operating configuration.

More specifically, the fracturing process is designed to increase the permeability of formation 14 adjacent to wellbore 32. Typical fracture fluids include water, oil, oil/water emulsion, gelled water, gelled oil, $CO_2$ and nitrogen foams or water/alcohol mixture. In addition, the fracture fluid may carry a suitable propping or solid agent 88, such as sand, gravel or engineered proppants, into fractures 84 for the purpose of holding fractures 84 open following the fracturing operation, as best seen in FIG. 6.

During the fracture operation, fracture fluid 82 must be forced into formation 14 at a flow rate great enough to generate the required pressure to fracture formation 14 allowing the entrained proppants 88 to enter fractures 84 and prop the formation structures apart. Proppants 88 produce channels which will create highly conductive paths reaching out into formation 14, which increases the reservoir permeability in the fracture region.

Importantly, during the fracture operation, the downhole completion system of the present invention allows for live annulus pressure readings using a pressure gauge proximate the surface to monitor the formation reaction. More specifically, any change in pressure by formation reaction is transmitted to the annulus above seal assembly 74 as the interior of screen wrapped sliding sleeve 76 is in fluid communication with formation 14 and the annulus above seal assembly 74 as indicated by arrows 86 in FIG. 5. By maintaining a live annulus, the pressure measurements taken to monitor formation reaction to the fracturing are much more realistic as compared to pressure reading taken proximate the surface within tubing string 30 as the friction pressure associated with pumping the treatment slurry through tubing string 30 has been eliminated. Having accurate pressure measurements of formation reaction improves the fracture stimulation operation by allowing substantially real time adjustments to be made during the fracture operation to fracture operation parameters including flow rate, fluid viscosity, proppant concentration and the like.

When fractures 84 in formation 14 stop propagating, proppants 88 within fracture fluid 82 build up within fractures 84 and within wellbore 32 around sand control screen assembly 58 and blank pipe 60. At this screen out point, as best seen in FIG. 6, the fracture operation is complete and the remaining treatment slurry in tubing string assembly 40 is reversed out. Using a slickline or other suitable equipment, ported sleeve 66 and screen wrapped sliding sleeve 76 are operated to their closed positions and tubing string assembly 40 is pressure tested against flow control device 62. Using a slickline and suitable bailing equipment any remaining proppants within tubing string assembly 40 are removed and the dart within flow control device 62 is retrieved to the surface allowing production to commence from formation 14.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for completing a well that traverses a production interval, the method comprising the steps of:

positioning a tubing string assembly within the well proximate the production interval;

isolating the production interval;

pumping a treatment fluid through the tubing string assembly and into the production interval;

communicating fluid pressure from within the tubing string assembly to an annulus uphole of the isolated production interval during the pumping of the treatment fluid; and obtaining a pressure reading in the annulus uphole of the isolated production interval to monitor a formation reaction to the treatment during the pumping of the treatment fluid.

2. The method as recited in claim 1 further comprising the step of positioning a perforating assembly within the well and perforating a casing adjacent to the production interval.

3. The method as recited in claim 2 wherein the step of positioning a perforating assembly within the casing further comprises connecting the perforating assembly to a downhole end of the tubing string assembly and disconnecting the tubing string assembly from the perforating assembly when the perforating assembly is positioned proximate the production interval.

4. The method as recited in claim 2 wherein the step of positioning a tubing string assembly within the casing further comprises contacting a downhole end of the tubing string assembly with an uphole end of the perforating assembly and retrieving the tubing string assembly uphole a predetermined distance.

5. The method as recited in claim 2 wherein the step of perforating the casing further comprises the step of operating the perforating assembly in an underbalanced hydrostatic pressure regime.

6. The method as recited in claim 5 wherein the step of operating the perforating assembly in an underbalanced hydrostatic pressure regime further comprising the steps of pumping a completion fluid into the tubing string and operating a flow control device within the tubing string to a closed position.

7. The method as recited in claim 1 further comprising the steps of removing a rig from the well and installing a wellhead before the step of pumping a treatment fluid through the tubing string assembly and into the production interval.

8. The method as recited in claim 1 wherein the step of isolating the production interval further comprises mechanically setting one seal assembly and hydraulically setting another seal assembly.

9. The method as recited in claim 1 wherein the step of pumping a treatment fluid through the tubing string assembly and into the production interval further comprises hydraulically fracturing the production interval by at least temporarily preventing returns from flowing into the tubing string assembly.

10. The method as recited in claim 1 further comprising the step of packing at least a portion of a production annulus within the isolated production interval.

11. The method as recited in claim 1 wherein the step of obtaining a pressure reading in the annulus further comprises obtaining a pressure reading proximate the surface.

12. The method as recited in claim 1 wherein the step of communicating fluid pressure from within the tubing string assembly to an annulus uphole of the isolated production interval further comprises allowing at least a portion of a fluid component of the treatment fluid to enter the annulus and preventing a solid component of the treatment fluid from entering the annulus.

13. The method as recited in claim 1 further comprising the step of altering a parameter associated with the treatment fluid as a result of the monitored formation reaction.

14. A method for completing a well having a casing that traverses a production interval, the method comprising the steps of:

positioning a perforating assembly within the casing proximate the production interval;

positioning a tubing string assembly within the casing uphole of the perforating assembly;

perforating the casing adjacent to the production interval;

repositioning the tubing string assembly downhole within the casing and isolating the production interval;

pumping a treatment fluid through the tubing string assembly and into the production interval;

communicating, fluid pressure from within the tubing string assembly to an annulus uphole of the isolated production interval during the pumping of the treatment fluid; and obtaining a pressure reading in the annulus uphole of the isolated production interval to monitor a formation reaction to the treatment during the pumping of the treatment fluid.

15. The method as recited in claim 14 wherein the step of positioning a perforating assembly within the casing further comprises positioning the perforating assembly within the casing using a conveyance prior to positioning the tubing string assembly within the casing.

16. The method as recited in claim 14 wherein the step of positioning a perforating assembly within the casing further comprises connecting the perforating assembly to a downhole end of the tubing string assembly and disconnecting the tubing string assembly from the perforating assembly when the perforating assembly is positioned proximate the production interval.

17. The method as recited in claim 14 wherein the step of positioning a tubing string assembly within the casing further comprises contacting a downhole end of the tubing string assembly with an uphole end of the perforating assembly and retrieving the tubing string assembly uphole a predetermined distance.

18. The method as recited in claim 14 wherein the step of perforating the casing further comprises the step of operating the perforating assembly in an underbalanced hydrostatic pressure regime.

19. The method as recited in claim 18 wherein the step of operating the perforating assembly in an underbalanced hydrostatic pressure regime further comprising the steps of pumping a completion fluid into the tubing string and operating a flow control device within the tubing string to a closed position.

20. The method as recited in claim 14 further comprising the step of releasing the perforating assembly downhole after the step of perforating the casing adjacent to the production interval.

21. The method as recited in claim 14 further comprising the step of retrieving the perforating assembly uphole through the tubing string assembly after the step of perforating the casing adjacent to the production interval.

22. The method as recited in claim 14 further comprising the steps of removing a rig from the well and installing a wellhead before the step of pumping a treatment fluid through the tubing string assembly and into the production interval.

23. The method as recited in claim 14 wherein the step of isolating the production interval further comprises mechanically setting one seal assembly and hydraulically setting another seal assembly.

24. The method as recited in claim 14 wherein the step of pumping a treatment fluid through the tubing string assembly and into the production interval further comprises hydraulically fracturing the production interval by at least temporarily preventing returns from flowing into the tubing string assembly.

25. The method as recited in claim 14 further comprising the step of packing at least a portion of a production annulus within the isolated production interval.

26. The method as recited in claim 14 wherein the step of obtaining a pressure reading in the annulus further comprises obtaining a pressure reading proximate the surface.

27. The method as recited in claim 14 wherein the step of communicating fluid pressure from within the tubing string assembly to an annulus uphole of the isolated production interval further comprises allowing at least a portion of a fluid component of the treatment fluid to enter the annulus and preventing a solid component of the treatment fluid from entering the annulus.

28. The method as recited in claim 14 further comprising the step of altering a parameter associated with pumping the treatment fluid as a result of monitored formation reaction.

29. A method f or completing a well having a casing that traverses a production interval, the method comprising the steps of:

positioning a perforating assembly within the casing proximate the production interval;

positioning a tubing string assembly within the casing uphole of the perforating assembly, the tubing string assembly including a pair of seal assemblies, a screen assembly and a ported sleeve positioned between the seal assemblies and a radial fluid communication device positioned uphole of the seal assemblies;

perforating the casing adjacent to the production interval and releasing the perforating assembly downhole;

repositioning the tubing string assembly within the casing such that the screen assembly is proximate the production interval and setting the seal assemblies to isolate the production interval;

hydraulically fracturing the production interval with a treatment fluid pumped through the tubing string and the ported sleeve; and monitoring a formation reaction to the fracturing by obtaining a pressure reading uphole of the isolated production interval in an annulus in fluid communication with the radial fluid communication device during the pumping of the treatment fluid.

30. The method as recited in claim 29 wherein the step of positioning a perforating assembly within the casing further comprises positioning the perforating assembly within the casing using a conveyance prior to positioning the tubing string assembly within the casing.

31. The method as recited in claim 29 wherein the step of positioning a perforating assembly within the casing further comprises connecting the perforating assembly to a downhole end of the tubing string assembly and disconnecting the tubing string assembly from the perforating assembly when the perforating assembly is positioned proximate the production interval.

32. The method as recited in claim 29 wherein the step of positioning a tubing string assembly within the casing further comprises contacting a downhole end of the tubing string assembly with an uphole end of the perforating assembly and retrieving the tubing string assembly uphole a predetermined distance.

33. The method as recited in claim 29 wherein the step of perforating the casing further comprises the step of operating the perforating assembly in an underbalanced hydrostatic pressure regime.

34. The method as recited in claim 33 wherein the step of operating the perforating assembly in an underbalanced hydrostatic pressure regime further comprising the steps of pumping a completion fluid into the tubing string and operating a flow control device within the tubing string to a closed position.

35. The method as recited in claim 29 wherein before the step of hydraulically fracturing the well, the steps of removing a rig from the well and installing a wellhead.

36. The method as recited in claim 29 wherein the step of setting the seal assemblies further comprises mechanically setting one of the seal assemblies and hydraulically setting the other of the seal assemblies.

37. The method as recited in claim 29 wherein the step of hydraulically fracturing the well further comprises at least temporarily preventing flow from within the tubing string to an interior of the screen assembly.

38. The method as recited in claim 37 wherein the step of temporarily preventing flow from within the tubing string to an interior of the screen assembly further comprises closing a flow control device positioned between the screen assembly and the ported sleeve.

39. The method as recited in claim 29 further comprising the step of packing an annulus between the screen assembly and the perforated section of casing.

40. The method as recited in claim 29 wherein the step of monitoring the formation reaction to the fracturing further comprises obtaining a pressure reading proximate the surface.

41. The method as recited in claim 29 wherein the step of monitoring the formation reaction to the fracturing further comprises allowing at least a portion of the treatment fluid to pass through the radial fluid communication device into the annulus.

42. The method as recited in claim 29 further comprising the step of altering a parameter associated with pumping the treatment fluid as a result of monitored formation reaction.

43. A system for completing a well having a casing that traverses a production interval, the system comprising:

a perforating assembly positioned within the casing proximate the production interval; and a tubing string assembly having first and second positions within the casing, the tubing string assembly including a pair of seal assemblies, a screen assembly and a ported sleeve positioned between the seal assemblies and a radial fluid communication device positioned uphole of the seal assemblies, in the first position, the tubing string assembly is positioned uphole of the perforating assembly, the perforating assembly is operated to form perforations in the casing adjacent to the production interval and the perforating assembly is released downhole, in the second position, the tubing string assembly is positioned such that the screen assembly is proximate the production interval, the seal assemblies are set to isolate the production interval, the production interval is hydraulically fractured by pumping a treatment fluid through the tubing string and the ported sleeve and a formation reaction to the fracturing is monitored by obtaining a pressure reading during the pumping of the treatment fluid and uphole of the isolated production interval in an annulus in fluid communication with the radial fluid communication device.

44. The system as recited in claim 43 further comprising a conveyance that positions the perforating assembly within the casing.

45. The system as recited in claim 43 wherein the perforating assembly is initially connected to a downhole end of the tubing string assembly and is disconnected from the tubing string assembly when the perforating assembly is positioned proximate the production interval.

46. The system as recited in claim 43 wherein the location of the first position of the tubing string assembly is determined by contacting a downhole end of the tubing string assembly with an uphole end of the perforating assembly and retrieving the tubing string assembly uphole a predetermined distance.

47. The system as recited in claim 43 further comprising an underbalanced hydrostatic pressure regime when the perforating assembly is operated.

48. The system as recited in claim 47 wherein the underbalanced hydrostatic pressure regime is created by pumping a completion fluid into the tubing string and operating a flow control device within the tubing string to a closed position.

49. The system as recited in claim 43 wherein a rig is used to move the tubing string assembly from the first position to the second position and the rig is removed from the well after the tubing string assembly is in the second position.

50. The system as recited in claim 43 wherein a wellhead is installed on the well after the tubing string assembly is in the second position.

51. The system as recited in claim 43 wherein one of the seal assemblies further comprises a seal assembly that is mechanically set.

52. The system as recited in claim 43 wherein one of the seal assemblies further comprises a seal assembly that is hydraulically set.

53. The system as recited in claim 43 further comprising a flow control device positioned between the first screen assembly and the ported sleeve that temporarily prevents flow from within the tubing string to an interior of the first screen assembly when the well is hydraulically fractured.

54. The system as recited in claim 43 further comprising a pressure sensor positioned proximate the surface in an annulus surrounding the second screen assembly that monitors the formation reaction to the fracturing.

55. The system as recited in claim 43 wherein at least a portion of a fluid component of the treatment slurry passes through the second screen assembly, thereby allowing the formation reaction to the fracturing to be monitored.

* * * * *